US005139569A

United States Patent [19]

Gross et al.

[11] Patent Number: 5,139,569

[45] Date of Patent: Aug. 18, 1992

[54] PROCESS FOR THE PRODUCTION OF ALLOY STEEL GRADES USING TREATMENT GAS CONSISTING OF $CO_2$

[75] Inventors: Gerhard Gross, Willich; Marjan Velikonja, Wiehl, both of Fed. Rep. of Germany

[73] Assignee: Messer Griesheim, Fed. Rep. of Germany

[21] Appl. No.: 814,235

[22] Filed: Dec. 23, 1991

Related U.S. Application Data

[63] Continuation of Ser. No. 506,960, Apr. 10, 1990, abandoned.

[30] Foreign Application Priority Data

Apr. 13, 1989 [DE] Fed. Rep. of Germany ..... 3912061

[51] Int. Cl.[5] ..... C21C 5/30

[52] U.S. Cl. ..... 75/543; 75/547

[58] Field of Search ..... 75/543, 547

[56] References Cited

U.S. PATENT DOCUMENTS

| | | | |
|---|---|---|---|
| Re. 29,584 | 3/1978 | Heise | 75/557 |
| 4,225,341 | 9/1980 | Nilles | 75/559 |
| 4,450,005 | 5/1984 | Nakao et al. | 75/557 |
| 4,555,266 | 11/1985 | Wells | 75/557 |

FOREIGN PATENT DOCUMENTS

| | | | |
|---|---|---|---|
| 60212 | 5/1979 | Japan | 75/557 |
| 2617 | 1/1985 | Japan | 75/557 |
| 624923 | 9/1978 | U.S.S.R. | 75/557 |

*Primary Examiner*—Melvyn J. Andrews
*Attorney, Agent, or Firm*—Connolly & Hutz

[57] ABSTRACT

In secondary steel refining, in addition to the process gas oxygen, the gases nitrogen and argon are employed as treatment gases in the bottom blowing converter. Oxygen and argon can be partially replaced by inexpensive $CO_2$. The invention provides a process which makes it possible to completely replace nitrogen and argon by $CO_2$.

13 Claims, 2 Drawing Sheets

A
B
C
t [min]
0
5
10
15
20
25
30
35
x
y
C
T
M
S
TEMPERATUR °C
1700
1650
1600
1550
N, S ppm
%C x 10⁻³
500
400
300
200
100
50
30
20
10
GAS
(m³/min)
Ar / N2
O2
Ar
N2

A
B
C
t [min]
0
5
10
15
20
25
30
35
x/y
TEMPERATUR °C
1700
1650
1600
1550
N, S ppm
500
400
300
200
100
50
30
20
10
% C x 10^-3
C
T
N
S
GAS
(m³/min)
CO2
O2

PROCESS FOR THE PRODUCTION OF ALLOY STEEL GRADES USING TREATMENT GAS CONSISTING OF $CO_2$

CROSS REFERENCE TO RELATED APPLICATION

This application is a continuation of application Ser. No. 07/506,960, filed Apr. 10, 1990, now abandoned.

BACKGROUND OF INVENTION

The aftertreatment of alloy steel grades in bottom blowing converters is carried out with oxygen as the process gas, and with nitrogen and argon as the treatment gas. Such secondary steel-refining processes are known by the abbreviations MRP (Metal Refining Process), AOD (Argon-Oxygen Decarburization), UBD (Under Bottom Blowing Decarburization) and ASM (Argon Secondary Metallurgy). They serve to refine low-alloy up to high-alloy steel grades in converter types of the same name having bottom-bath nozzles, whereby the steel grades are smelted in an arc furnace. Non-alloy types of steel are not usually produced in such converters. However, in order to achieve high quality, there are manufacturers who, despite higher costs, refine non-alloy steel types in such converters even though refining in an arc furnace would be less expensive.

In this context, it is known from West German patent no. DE-PS 2,430,975 corresponding to U.S. Pat. No. Re. 29,584 to partially replace the nitrogen and the argon by mixing them with $CO_2$. West German patent no. DE-PS 934,772 shows a process for the production of non-alloy steel in a Bessemer-Thomas converter, which is low in toxic gases. In this process, $CO_2$ is admitted into the bath either as a gas or by adding limestone alone or else mixed with oxygen.

SUMMARY OF THE INVENTION

It is common practice in secondary steel refining to first smelt the steel melt in a smelting furnace and then to transfer it to a fresh tank, in other words, a converter. The melt is treated in this converter in that the process and treatment gases are blown into the melt through the bottom of the converter. For this purpose, metallic jacket gas nozzles are usually employed, with which the process gas is admitted through the middle nozzle, and the treatment gases are admitted through the ring nozzle. The treatment gases admitted through the ring nozzle are inert gases and they serve primarily to cool the metallic nozzles during the blowing process and to blend the melt. In this case, the inert gases are Ar and $N_2$. By partially replacing these inert gases with $CO_2$, it is possible to reduce the specific gas costs.

Treatment of the melt in the converter is carried out in three process phases, namely, decarburizing, heating and mixing. Desulfurizing and alloying are done concurrently with the heating step. These three phases are followed by sampling, temperature measurement and the addition of metallic and non-metallic solids, and they are carried out at different times.

THE DRAWINGS

FIGS. 1-2 schematically show the process sequence for treatment with $N_2$ and Ar for the alloy grade and steel grade 42 CrMo 4, respectively, in accordance with this invention.

DETAILED DESCRIPTION

Figures 1A, 1B:
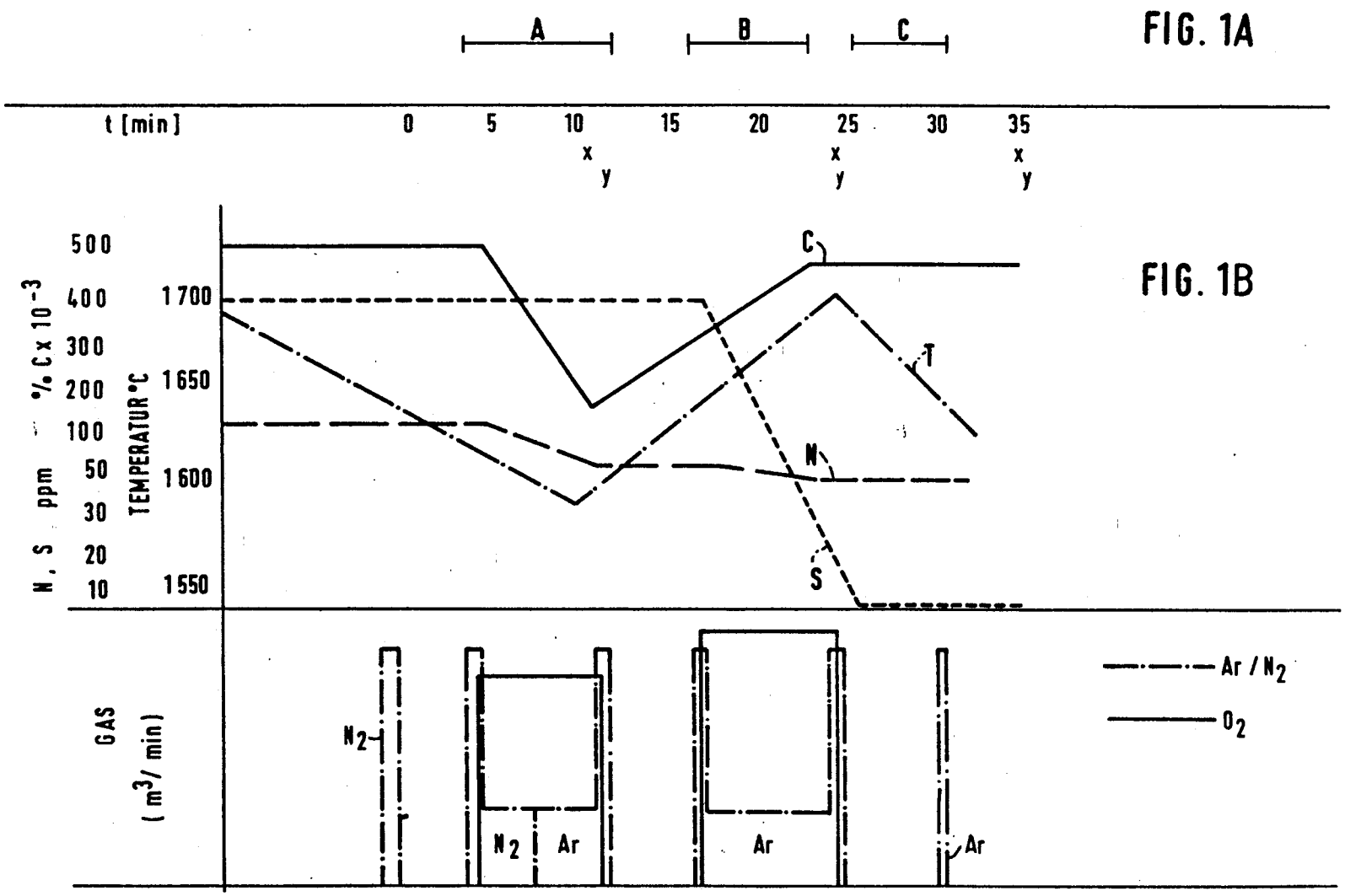

FIG. 1 schematically shows a process sequence for treatment with the inert gases $N_2$ and Ar for the alloy steel grade 42 CrMo 4. This sequence encompasses the decarburization by means of area A, heating by means of area B and mixing by means of area C. The measured points x for the temperature measurements and y for the sampling are given below the line which depicts the time course in minutes. Beneath that, the concentration curves of nitrogen and sulfur as well as carbon (N, S, C), and the temperature curve T are given. The use of the process gas oxygen and of the inert and treatment gases argon and nitrogen with respect to time and amounts are presented in the lower section of FIG. 1.

The invention is based on the task of further reducing the gas-related costs within the scope of the secondary steel refining of alloy steel grades.

The process according to the invention stems from the surprising observation that the inert gases $N_2$ and Ar can be replaced by $CO_2$ not only partially but completely, as a result of which the gas-related costs in secondary refining of steel can be drastically reduced. The volume of $CO_2$ admitted to the melt per time unit has to be such that sufficient mixing energy is applied to the melt. Then it is possible for all of the reactions to take place under conditions of equilibrium. In the process according to the invention, $N_2$ and Ar can be completely replaced by $CO_2$ in all three process phases of the steel treatment, that is, during decarburization, heating and mixing.

Figures 2A, 2B:
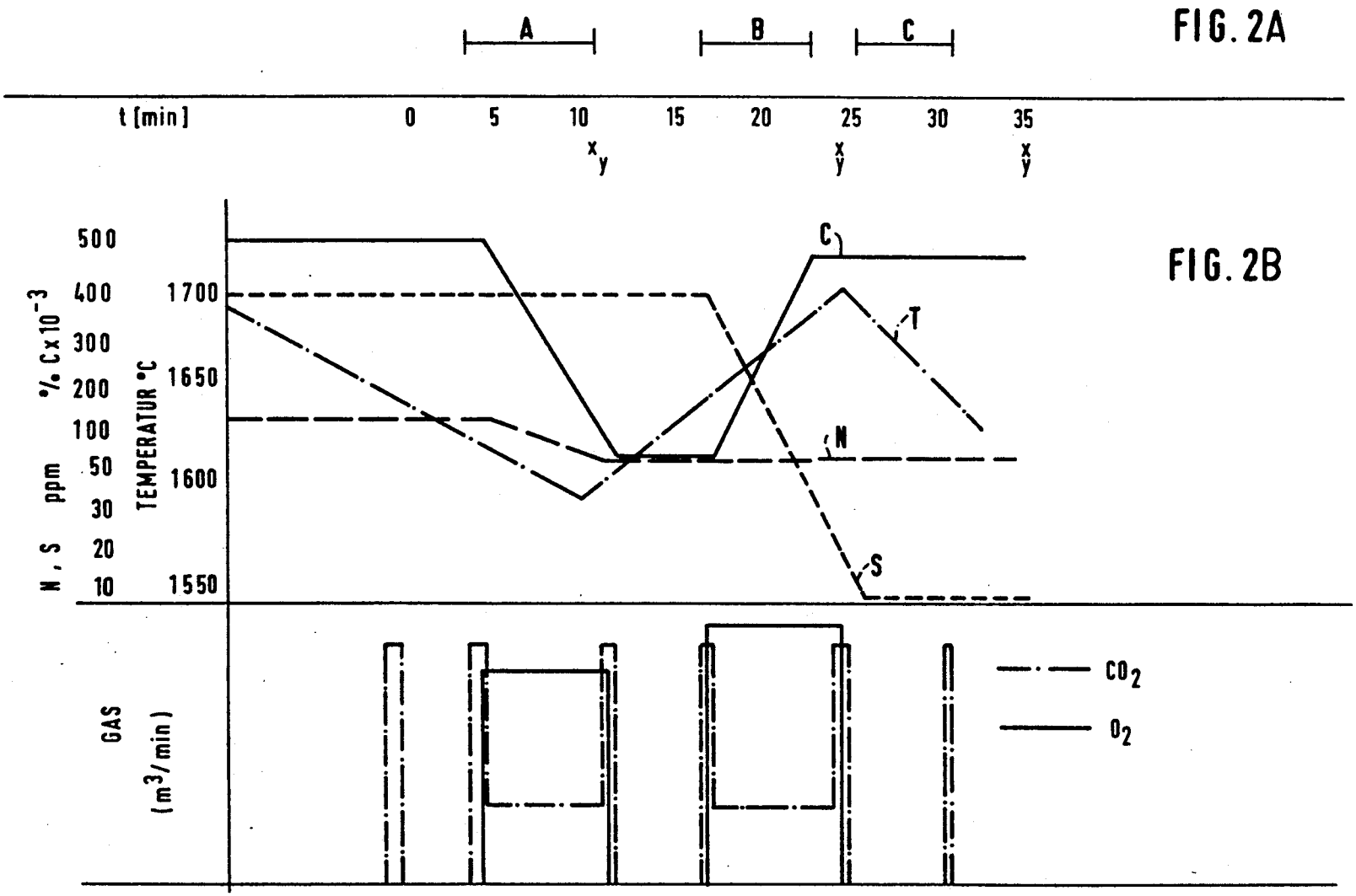

The schematic sequence of the process according to the invention is shown in FIG. 2, likewise for steel grade 42 CrMo 4 as in FIG. 1. This clearly shows that essentially the same treatment result is obtained.

The $CO_2$ has differing effects in the individual process phases. This is described below.

When the converter is moved from the lying or horizontal position to the upright, blowing position at the beginning of the treatment process, the nozzles must receive inert gas in order to prevent the melt from penetrating them. For the sake of safety, it is only possible to admit $CO_2$ when the blowing position has been reached. Corresponding measures must be taken when the converter is tipped back to its lying position. The volumes of gas admitted to the nozzles during such changes of the position of the converter are called safety volumes.

During decarburization of the melt with oxygen, the $CO_2$ makes up the safety gas volume when the converter is placed in the blowing position. Subsequently, oxygen is blown in through the middle nozzle, and the ring nozzle is continuously cooled by means of $CO_2$. By admitting oxygen and $CO_2$ together, the partial pressure of the $N_2$ and $H_2$ is reduced during the decarburization phase. This leads to degasing of the melt. At the same time, a charging of the melt with the gases $N_2$ and $H_2$ is prevented, so that, for the most part, steel types low in $N_2$ and $H_2$ are obtained.

With the reaction of $CO_2+C=2\ CO$, $CO_2$ is additionally employed to decarburize the melt, that is to say, $CO_2$ is an additional oxygen carrier in the decarburization phase.

During the subsequent heating phase, the use of $CO_2$ for desulfurization and alloying has a different effect. In this context, the melt is heated up to the desired temperature by means of the exothermic reaction of oxygen with the aluminum, silicon or aluminum-silicon mixture added. Up until now, in the treatment phase, only argon has been used as the treatment gas since nitrogen would dissolve in the melt, thus giving rise to an undesired charging of the melt with nitrogen.

When replacing argon with $CO_2$, the following reactions must be taken into consideration:

$$3\ CO_2 + 4\ Al = 2\ Al_2O_3 + 3\ C \quad (1)$$

$$3\ CO_2 + 2\ Al = Al_2O_3 + 3\ CO \quad (2)$$

Or $$CO_2 + Si = SiO_2 + C \quad (3)$$

$$CO_2 + Si = SiO + CO \quad (4)$$

Both reactions take place during the heating phase, as a function of the concentration of aluminum in the melt. Analogous to equation (1) or (3), the melt is carburized during the heating phase, the $CO_2$ is completely reduced by the aluminum and a carbon atom is released. At the same time, reaction (2) or (4), that is to say, the partial reduction of $CO_2$ takes place, and these reactions do not result in the carburization of the melt. For each melt, it is possible to calculate the carburization of the melt in advance during the heating phase and then to take this into consideration by means of more thorough decarburization during the decarburization step.

As can be seen in FIGS. 1 and 2, a carburization of the melt takes place during the heating phase. This carburization can be calculated on the basis of the following calculation:

$$dC = \frac{536 \times Q \times Cf}{C}$$

dC—carburization rate in ppm C/min
Q—flow volume of $CO_2$-inert gas $m^3$/min
Cf—carburization factor 0.3 to 0.5
G—melt weight in tons In a 10-ton converter with the carburization factor Cf=0.5, at an inert gas volume of 2 $m^3$, the carburization rate is $$dC = 536 \times 2 \times 0.5/10 = 53.6\ ppm\ C/min.$$

Tables 1 and 2 below present the effect of the use of $CO_2$ according to the invention in the decarburization and heating phase for several steel grades. Table 1, which shows the degasing of the melt measured according to the content of nitrogen, also shows the operational results of the commonly used process with nitrogen and argon, as well as the results of the process according to the invention.

TABLE 1

Degasing of the melt, measured according to the nitrogen content

| melt steel grade | gas consumption $O_2$ $m^3$/t | $N_2$ $m^3$/t | Ar $m^3$/t | gas content $CO_2$ $m^3$/t | nitrogen start | end |
|---|---|---|---|---|---|---|
| 20 Mn 5 | 12.9 | 3.4 | 5.9 | — | 99 | 43 |
| 17 CrMo 55 | 12.1 | 3.7 | 6.0 | — | 122 | 75 |
| 42 CrMo 4 | 11.0 | 3.5 | 2.4 | — | 125 | 107 |
| 17 CrMoV 5.11 | 16.6 | 2.4 | 8.0 | — | 105 | 77 |
| 10 MnMo 74 | 16.1 | — | — | 9.8 | 96 | 69 |
| 17 CrMo 5.11 | 17.1 | — | — | 10.9 | 110 | 76 |
| 42 CrMo 4 | 12.6 | — | — | 7.9 | 104 | 62 |
| 34 NiCrMo 14 | 18.6 | — | — | 11.7 | 106 | 73 |

TABLE 2

Decarburization of the melt during the heating step

| Steel grade | carbon content start % | end % | gas consumption $O_2$ $m^3$/min | $m^3$/t | $CO_2$ $m^3$/min | heating with Al $m^3$/n | kg/t |
|---|---|---|---|---|---|---|---|
| 10 MnMo 74 | 0.04 | 0.08 | 9.0 | 6.0 | 2.4 | 3.0 | 10 |
| 17 CrMoV 5.11 | 0.12 | 0.16 | 3.0 | 9.0 | 2.3 | 3.0 | 10 |
| 42 CrMo 4 | 0.27 | 0.30 | 9.0 | 5.6 | 2.4 | 2.7 | 9 |
| 35 CrNiMo 14 | 0.27 | 0.32 | 9.0 | 6.6 | 2.4 | 3.5 | 11 |

A crucial factor for the effectiveness of the process according to the invention, particularly during the heating phase, is the purity of the $CO_2$. After all, the reduction of the melt by means of aluminum brings about a higher degree of solubility of nitrogen in the steel. For this reason, the nitrogen and hydrogen impurities in the $CO_2$are absorbed by the melt and can no longer be removed. In order to prevent this, for the metallurgical treatment of steel according to the invention, technically pure $CO_2$ with a maximum of 500 vpm ppm of $N_2$ and 50 vpm ppm of $H_2O$ must be used. This degree of purity is preferably obtained by evaporating the $CO_2$ from the liquid phase.

In the mixed phase, according to the invention $CO_2$ also completely replaced the argon. According to the state of the art, shortly before tapping, the melt is mixed with argon for 1 to 2 minutes so that temperature equilibrium can be achieved. When argon is replaced by $CO_2$, an oxidation of the melt takes places directly before tapping after the reactions mentioned during the description of the heating phase. By means of the stoichiometric addition of approximately 1.0 kg of Al/$M^3$ of $CO_2$, this change of the analysis is compensated for. The simultaneous carburization can be ignored, since it only amounts to 50 ppm and thus falls within the analysis tolerance limits.

What is claimed is:

1. In a process for the production of non-alloy and alloy steel grades with up to ten percent of alloy elements in a secondary steel-refining convertor in which oxygen and a treatment gas are blown into the convertor having a carbon containing melt, the process including a first phase during which oxygen is blow in as a process gas to reduce the carbon content of the melt by the oxygen reacting with the carbon present in the melt and during which a treatment gas is blow in for cooling purposes; adding aluminum, silicon or an aluminum-silicon mixture to the melt during a second phase after the first phase, blowing in oxygen during the second phase with the oxygen exothermically reacting with added aluminum, silicon or aluminum-silicon mixture, and blowing in the treatment gas during the second phase for cooling purposes, the improvement being in that the treatment gas throughout the carbon reduction consisting of gaseous $CO_2$.

2. Process according to claim 1 characterized in that there is a third phase subsequent to the second phase, and a blowing in a treatment gas consisting of $CO_2$ during the third phase to effect a temperature equilibrium in the melt.

3. Process according to claim 2 characterized in that the $CO_2$ functions as an added oxygen carrier during the first phase.

4. Process according to claim 2, characterized in that 0.2 to 1.0 $m^3$/ min of $CO_2$ are blown in per ton of steel.

5. Process according to claim 2, characterized in evaporating the liquid phase of $CO_2$ to obtain the gaseous $CO_2$.

6. The process according to claim 2 characterized in adding Al or Si to carburize the melt during the second phase.

7. Process according to claim 1 characterized in stoichiometrically adding 1.0 kg of aluminum/$m^3$ of $CO_2$ to prevent a change in the analysis as a result of the reoxidation of the melt during the third phase with pure $CO_2$.

8. Process according to claim 2 characterized in that the $CO_2$ treatment gas contains as impurities a maximum of 500 ppm of $N_2$ and a maximum of 50 ppm of $H_2O$.

9. The process according to claim 8 characterized in evaporating the liquid phase of $CO_2$ to obtain the gaseous $CO_2$.

10. Process according to claim 2, characterized in that 0.2 to 1.0 $m^3$/min of $CO_2$ are blown in per ton of steel.

11. The process according to claim 10 characterized in adding Al or Si to carburize the melt during the second phase.

12. Process according to claim 11, characterized in that the carburization rate dC is determined according to the formula $$dC = \frac{536 \times Q \times Cf}{C}$$

wherein dC is the carburization rate in ppm C/min

Q is the flow volume of $CO_2$ gas $m^3$/min

Cf is the carburization factor 0.3 to 0.5, and

G is the weight of the melt in tons.

13. Process according to claim 12 characterized in stoichiometrically adding 1.0 kg of aluminum/$m^3$ of $CO_2$ to prevent a change in the analysis as a result of the reoxidation of the melt during the third phase with pure $CO_2$.

* * * * *